US009214272B2

(12) United States Patent
Duval

(10) Patent No.: US 9,214,272 B2
(45) Date of Patent: Dec. 15, 2015

(54) THREE-PHASE-TWO-PHASE STATIONARY TRANSFORMER WITH FORCED LINKED FLUX

(71) Applicant: LABINAL POWER SYSTEMS, Blagnac (FR)

(72) Inventor: Cedric Duval, Samois sur Seine (FR)

(73) Assignee: LABINAL POWER SYSTEMS, Blagnac (FR)

( * ) Notice: Subject to any disclaimer, the term of this patent is extended or adjusted under 35 U.S.C. 154(b) by 0 days.

(21) Appl. No.: 14/390,929

(22) PCT Filed: Apr. 3, 2013

(86) PCT No.: PCT/FR2013/050731

§ 371 (c)(1),
(2) Date: Oct. 6, 2014

(87) PCT Pub. No.: WO2013/150240

PCT Pub. Date: Oct. 10, 2013

(65) Prior Publication Data

US 2015/0077207 A1 Mar. 19, 2015

(30) Foreign Application Priority Data

Apr. 6, 2012 (FR) ..... 12 53183

(51) Int. Cl.

| | |
|---|---|
| ***H01F 27/02*** | (2006.01) |
| ***H01F 27/30*** | (2006.01) |
| ***H01F 30/14*** | (2006.01) |
| ***H01F 27/24*** | (2006.01) |
| ***H01F 27/28*** | (2006.01) |

(52) U.S. Cl.

CPC ..... *H01F 27/30* (2013.01); *H01F 27/02* (2013.01); *H01F 27/24* (2013.01); *H01F 27/2823* (2013.01); *H01F 30/14* (2013.01)

(58) Field of Classification Search

CPC ..... H01F 5/00; H01F 27/00–27/30
USPC ..... 336/65, 83, 170, 173, 180–184, 336/220–223, 212
IPC ..... H01F 5/00, 27/28, 27/30
See application file for complete search history.

(56) References Cited

U.S. PATENT DOCUMENTS

| | | | | |
|---|---|---|---|---|
| 3,725,730 | A * | 4/1973 | Nakai et al. | 315/144 |
| 2012/0153927 | A1 * | 6/2012 | Wolfus et al. | 323/310 |

FOREIGN PATENT DOCUMENTS

| | | |
|---|---|---|
| CH | 132421 | 4/1929 |
| FR | 2 648 612 | 12/1990 |
| WO | WO 2010086793 A1 * | 8/2010 |

OTHER PUBLICATIONS

International Search Report Issued Aug. 7, 2013 in PCT/FR13/050731 Filed Apr. 3, 2013.

*Primary Examiner* — Tuyen Nguyen
(74) *Attorney, Agent, or Firm* — Oblon, McClelland, Maier & Neustadt, L.L.P.

(57) ABSTRACT

A three-phase-two-phase transformer including a magnetic circuit, three-phase windings, and two-phase windings, wherein the magnetic circuit includes a first column, a second column, and a third column that are magnetically connected together, the three-phase windings including a first winding, a second winding, and a third winding. The two-phase windings include a fourth winding around the first column, a fifth winding around the first column, a sixth winding around the third column, and a seventh winding around the third column, the fourth winding and the seventh winding being connected in series and forming a first two-phase phase, and the fifth winding and the sixth winding being connected in series and forming a second two-phase phase.

6 Claims, 4 Drawing Sheets

THREE-PHASE-TWO-PHASE STATIONARY TRANSFORMER WITH FORCED LINKED FLUX

BACKGROUND OF THE INVENTION

The present invention relates to the general field of transformers. In particular, the invention relates to a three-phase-two-phase stationary transformer with forced linked flux.

In certain situations, it may be necessary to transfer energy in balanced manner from a three-phase source to a two-phase source. Three-phase-two-phase stationary transformers are known, and in particular one that is said to be "Scott-connected", and another that is said to be "Leblanc-connected".

A Scott-connected transformer makes use of two single-phase transformers. The first has its $n_1$ turn primary connected between terminals A and B of the three-phase network. The primary of the second transformer has $n_1'$ turns and it is mounted between terminal C of the three-phase network and the midpoint M of the primary of the first transformer. The two secondary phases both have the same number $n_2$ of turns. The primary voltages are in quadrature, and the same thus applies for the secondary voltages. To ensure that the secondary voltages have the same value and are in quadrature, it is necessary for:

$$n_1'=\sqrt{3}n_1/2$$

The Scott connection presents several drawbacks. The magnetic circuits of the two single-phase transformers present considerable weight and bulk. Furthermore, the windings of the two transformers need to be different on the three-phase side since they do not have the same numbers of turns. Since the numbers of turns for the three-phase phases are different, the sections of the electrical conductors need to be different in order to guarantee balanced resistances for each of the phases. A star connection is required and it is therefore not possible to act on the voltage ratios with a delta connection or a zigzag connection. Finally, no advantage can be taken of the positive coupling of phases in a three-phase transformer with forced linked flux, which coupling makes it possible to reduce the magnetizing current needed.

The Leblanc connection uses a magnetic circuit with three, four, or five columns. In a three-column magnetic circuit, the transformer is a forced linked flux transformer, thus making it possible to limit the magnetizing current.

The Leblanc connection also presents drawbacks. The windings of the phases on the two-phase side need to be different since they do not have the same numbers of turns. The windings on the two-phase side are distributed on the three columns in non-symmetrical manner, thereby giving rise to different leakage inductances. Since the numbers of turns in each of the phases on the two-phase side are different, it is necessary to use electrical conductors of different sections in order to balance the resistances of each of the phases.

There thus likewise exists a need for an improved solution enabling energy to be transferred in balanced manner from a three-phase source to a two-phase source.

OBJECT AND SUMMARY OF THE INVENTION

The invention provides a three-phase-two-phase transformer comprising a magnetic circuit, three-phase windings, and two-phase windings, wherein:

the magnetic circuit comprises a first column, a second column, and a third column that are magnetically connected together; and the three-phase windings comprise a first winding of $n_1$ turns around the first column, a second winding of $n_1$ turns around the second column, and a third winding of $n_1$ turns around the third column;

the transformer being characterized in that:

the two-phase windings comprise a fourth winding of $n_2$ turns around the first column, a fifth winding of $n'_2$ turns around the first column, a sixth winding of $n_2$ turns around the third column, and a seventh winding of $n'_2$ turns around the third column;

the fourth winding and the seventh winding are connected in series and form a first two-phase phase, and each of the fourth and seventh windings presents a corresponding winding direction for a current flowing in the first two-phase phase, with magnetic potentials in the same direction; and the fifth winding and the sixth winding are connected in series and form a second two-phase phase, and each of the fifth and sixth windings each presents a corresponding winding direction for a current flowing in the second two-phase phase, with magnetic potentials in the same direction.

On the three-phase side, the transformer presents a structure comparable to that of a three-column Leblanc type transformer. Thus, compared with using two single-phase transformers, it makes flux coupling possible, thereby enabling the weight and the volume of the magnetic circuit to be reduced and limiting magnetizing current. Furthermore, since both phases on the two-phase side present the same numbers of turns (namely $n_2+n'_2$), there is no need to use conductors of different sections for balancing resistances.

In an embodiment, $n_2=(2+\sqrt{3})n'_2$.

For a ratio $n_2=(2+\sqrt{3})n'_2$, the transformer makes it possible to obtain voltages on the two-phase side that have the same value and that are in quadrature.

In an embodiment, the second column is a central column situated between the first column and the third column. Under such circumstances, the three-phase windings and the two-phase windings are arranged symmetrically on the side columns, thereby enabling leakage inductances to be balanced.

In another embodiment, the first column is a central column situated between the second column and the third column.

Preferably, the magnetic circuit presents symmetry about an axis of rotation contained in the central column and/or about a plane of symmetry containing said central column.

Because of the symmetry of the magnetic circuit, of the three-phase windings, and of the two-phase windings, the phase inductances and the resistances are balanced.

In an embodiment, transformer also has at least one additional set of three-phase windings or of two-phase windings.

The transformer then makes it possible to power in balanced manner an arbitrary number of loads other than 1.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF EMBODIMENTS

Figure 1:
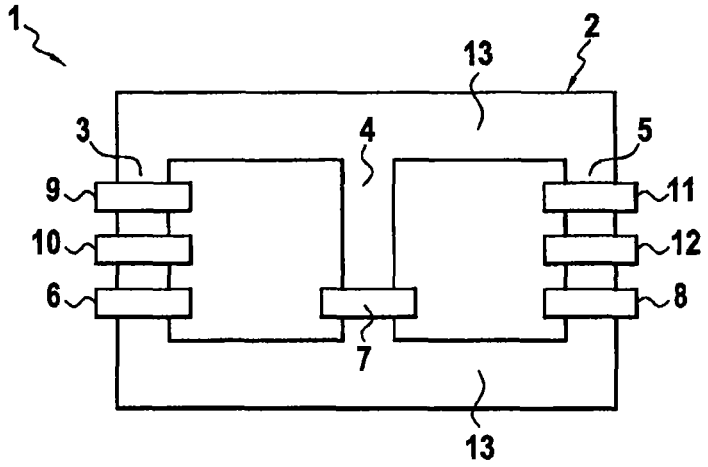
FIG. 1 shows a transformer in a first embodiment of the invention.

FIG. 1 is a face view of a transformer 1 in an embodiment of the invention. The transformer 1 is a three-phase-two-phase stationary transformer with forced linked flux.

The transformer 1 comprises a magnetic circuit 2, three-phase windings, and two-phase windings. In the description below, the three-phase windings correspond to the primary of the transformer 1 and the two-phase windings correspond to the secondary transformer 1. Nevertheless, an inverse mode of operation is entirely possible.

The magnetic circuit 2 comprises three columns that are magnetically connected together: a side column 3, a central column 4, and a side column 5; the columns being connected together by bars 13. The magnetic circuit 2 is symmetrical about an axis of rotation contained in the central column 4, and/or about a plane of symmetry containing the central column 4.

The three-phase windings comprise a winding 6 around the side column 3, a winding 7 around the central column 4, and a winding 8 around the side column 5.

The two-phase windings comprise a winding 9 and a winding 10 around the side column 3, and a winding 11 and a winding 12 around the side column 5.

In FIG. 1, the windings 9, 10, and 6 are shown one beside another along the central column 3, however any other positioning is possible. The same comment applies to the windings 11, 12, and 8.

Figure 2:
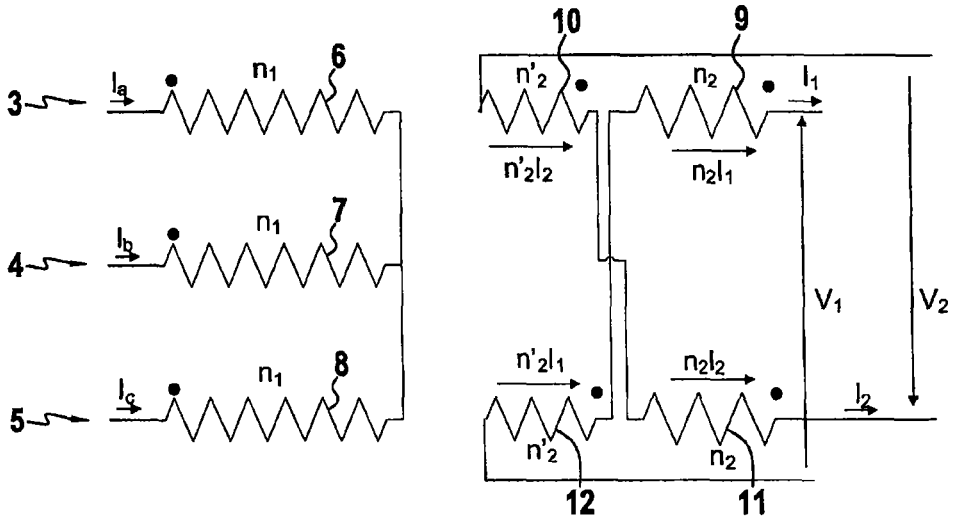
FIGS. 2 and 3 are electrical circuit diagrams showing the operation of the FIG. 1 transformer.

FIG. 2 is an electrical circuit diagram of the transformer 1 of FIG. 1.

Each of the three-phase windings 6, 7, and 8 presents $n_1$ turns. In the embodiment shown, they are star connected. Nevertheless, any other connection configuration is possible: delta, zigzag, . . . . The currents flowing respectively in the windings 6, 7, and 8 are written $I_a$, $I_b$, and $I_c$. The winding direction of each winding 6, 7, and 8 is represented by a black dot. Same-direction currents $I_a$, $I_b$, and $I_c$, correspond to same-direction magnetic potentials in the columns 3, 4, and 5.

For the two-phase side, the winding 9 has $n_2$ turns and is connected in series with the winding 12 that has $n'_2$ turns. The windings 9 and 12 correspond to a first two-phase phase. The current and the voltage of the first two-phase phase are written $I_1$ and $V_1$. The winding directions of the windings 9 and 12 are represented by black dots. For a given current $I_1$, the winding directions correspond to same-direction magnetic potentials $n_2I_1$ and $n'_2I_1$ in the columns 3 and 5.

Figure 3:
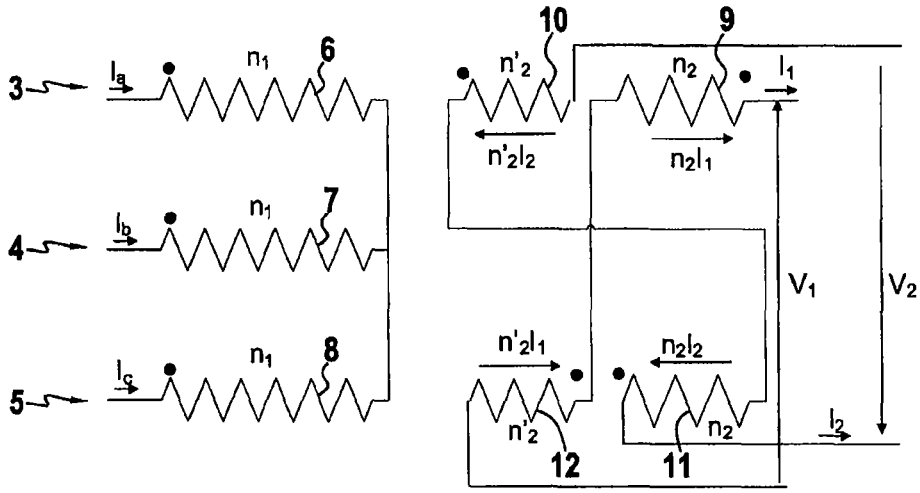

In corresponding manner, the winding 11 presents $n_2$ turns and is connected in series with the winding 10 that has $n'_2$ turns. The windings 11 and 10 correspond to a second two-phase phase. The current and the voltage in the second two-phase phase are written $I_2$ and $V_2$. The winding directions of the windings 10 and 11 are likewise represented by black dots. For a given current $I_2$, the winding directions correspond to same-direction magnetic potentials $n_2I_2$ and $n'_2I_2$ in the columns 5 and 3. This direction may be the same as the direction of the magnetic potentials $n_2I_1$ and $n'_2I_1$ of the first two-phase phase, as in FIG. 2, or it may be the opposite direction, as in the circuit of FIG. 3, which shows a variant embodiment.

On its three-phase side, the transformer 1 presents a structure comparable to that of a three-column Leblanc type transformer. Compared with using two single-phase transformers, it thus makes flux coupling possible, thereby enabling the weight and the volume of the magnetic circuit to be reduced and enabling the magnetizing current to be limited.

Furthermore, because of the symmetry of the magnetic circuit, of the three-phase windings, and of the two-phase windings, the phase inductances and resistances are balanced.

Since both phases on the two-phase side present the same number of turns (namely $n_2+n'_2$), there is no need to use conductors of different sections for balancing resistances.

Furthermore, for a ratio $n_2=(2+\sqrt{3})n'_2$, the transformer 1 enables same-value secondary voltages $V_1$ and $V_2$ to be obtained in quadrature.

The ratio of the currents is given by:

$$\frac{I_a}{I_1} = \frac{\sqrt{2}}{3}\frac{n_2+n'_2}{n_1}$$

The ration of the voltages is given by:

$$\frac{V_2}{V_a} = \frac{1}{\sqrt{2}}\frac{n'_2+n_2}{n_1}$$

Thus, the transformer 1 acts on the phase difference between the primary and the secondary, but delivers secondary currents $I_1$ and $I_2$ that are offset by a phase of $\pm\pi/2$, and secondary voltages $V_1$ and $V_2$ that are offset by a phase of $\pm\pi/2$.

This may be formalized as follows:

$$\begin{aligned}
\overline{V}_1 &= \frac{1}{n_1}(n_2\overline{V}_a + n'_2\overline{V}_c) \\
&= \frac{n'_2}{n_1}((2+\sqrt{3})\overline{V}_a + \overline{V}_c) \\
&= \frac{1}{\sqrt{2}}\frac{n'_2+n_2}{n_1}\frac{1}{\sqrt{3}\sqrt{2+\sqrt{3}}}\left(2+\sqrt{3}+\left(-\frac{1}{2}+j\frac{\sqrt{3}}{2}\right)\right)\overline{V}_a \\
&= \overline{V}_a\frac{1}{\sqrt{2}}\frac{n'_2+n_2}{n_1}\frac{1}{\sqrt{3}\sqrt{2+\sqrt{3}}}\left(\frac{3}{2}+\sqrt{3}+j\frac{\sqrt{3}}{2}\right) \\
&= \overline{V}_a\frac{1}{\sqrt{2}}\frac{n'_2+n_2}{n_1}\frac{1}{\sqrt{2+\sqrt{3}}}\left(\frac{\sqrt{3}}{2}+1+j\frac{1}{2}\right) \\
&= \overline{V}_a\frac{1}{\sqrt{2}}\frac{n'_2+n_2}{n_1}\left(\frac{\sqrt{2+\sqrt{3}}}{2}+j\frac{\sqrt{2-\sqrt{3}}}{2}\right) \\
&= \overline{V}_a\frac{1}{\sqrt{2}}\frac{n'_2+n_2}{n_1}e^{j\frac{\pi}{12}}
\end{aligned}$$

Thus giving:

$$\overline{V}_1 = \overline{V}_a\frac{1}{\sqrt{2}}\frac{n'_2+n_2}{n_1}e^{j\frac{\pi}{12}}$$

For $V_2$, the following applies:

$$\begin{aligned}
\overline{V}_2 &= \frac{1}{n_1}(n_2\overline{V}_c + n_2'\overline{V}_a) \\
&= \frac{n_2'}{n_1}\left((2+\sqrt{3})\overline{V}_c + \overline{V}_a\right) \\
&= \frac{1}{\sqrt{2}}\frac{n_2'+n_2}{n_1}\frac{1}{\sqrt{3}\sqrt{2+\sqrt{3}}}\left((2+\sqrt{3})*\left(-\frac{1}{2}+j\frac{\sqrt{3}}{2}\right)+1\right)\overline{V}_a \\
&= \overline{V}_a\frac{1}{\sqrt{2}}\frac{n_2'+n_2}{n_1}\frac{1}{\sqrt{3}\sqrt{2+\sqrt{3}}}\left(-\frac{\sqrt{3}}{2}+j\sqrt{3}\left(\frac{2+\sqrt{3}}{2}\right)\right) \\
&= \overline{V}_a\frac{1}{\sqrt{2}}\frac{n_2'+n_2}{n_1}\frac{1}{\sqrt{2+\sqrt{3}}}\left(-\frac{1}{2}+j\left(\frac{2+\sqrt{3}}{2}\right)\right) \\
&= \overline{V}_a\frac{1}{\sqrt{2}}\frac{n_2'+n_2}{n_1}\left(-\frac{\sqrt{2-\sqrt{3}}}{2}+j\left(\frac{\sqrt{2+\sqrt{3}}}{2}\right)\right) \\
&= \overline{V}_a\frac{1}{\sqrt{2}}\frac{n_2'+n_2}{n_1}e^{+j\frac{7\pi}{12}}
\end{aligned}$$

Thus giving:

$$\overline{V}_2 = \overline{V}_a\frac{1}{\sqrt{2}}\frac{n_2'+n_2}{n_1}e^{+j\frac{\pi}{12}}e^{+j\frac{\pi}{2}}$$

Thus, $V_2=jV_1$ is indeed obtained, i.e. the voltages have the same value and they are in quadrature.

If the secondary currents are balanced ($I_2=jI_1$), then the ampere-turn compensation on each core for a forced linked flux transformer of the three-column type shows that the primary currents are also balanced.

Specifically:

$$(1)\ n_1\bar{I}_A - n_1\frac{1}{2}\bar{I}_B - n_1\frac{1}{2}I_C = n_2\bar{I}_1 + n_2'\bar{I}_2 - \frac{1}{2}(n_2'\bar{I}_1 - n_2\bar{I}_2)$$

$$(1)\ n_1\bar{I}_A - n_1\frac{1}{2}\bar{I}_B - n_1\frac{1}{2}I_C = (2+\sqrt{3})n_2'\bar{I}_1 + jn_2'\bar{I}_1 - \frac{1}{2}\left(n_2'\bar{I}_1 + j(2+\sqrt{3})n_2'\bar{I}_1\right)$$

$$(1)\ n_1\bar{I}_A - n_1\frac{1}{2}\bar{I}_B - n_1\frac{1}{2}\bar{I}_C = \left[(2+\sqrt{3}) + j - \frac{1}{2}\left(1 + j(2+\sqrt{3})\right)\right][n_2'\bar{I}_1]$$

$$(1)\ n_1\bar{I}_A - n_1\frac{1}{2}\bar{I}_B - n_1\frac{1}{2}\bar{I}_C = \left[2+\sqrt{3}+j-\frac{1}{2}-j\frac{2+\sqrt{3}}{2}\right][n_2'\bar{I}_1]$$

$$(1)\ n_1\bar{I}_A - n_1\frac{1}{2}\bar{I}_B - n_1\frac{1}{2}\bar{I}_C = \left[\frac{3}{2}+\sqrt{3}-j\frac{\sqrt{3}}{2}\right][n_2'\bar{I}_1]$$

$$(1)\ n_1\bar{I}_A - n_1\frac{1}{2}\bar{I}_B - n_1\frac{1}{2}\bar{I}_C = \sqrt{2+\sqrt{3}} + \sqrt{3}\left[\frac{\sqrt{2+\sqrt{3}}}{2} - j\frac{\sqrt{2-\sqrt{3}}}{2}\right][n_2'\bar{I}_1]$$

$$(1)\ n_1\bar{I}_A - n_1\frac{1}{2}\bar{I}_B - n_1\frac{1}{2}\bar{I}_C = \frac{1}{\sqrt{2}}\left[\frac{\sqrt{2+\sqrt{3}}}{2} - j\frac{\sqrt{2-\sqrt{3}}}{2}\right][(n_2'+n_2)\bar{I}_1]$$

$$(1)\ n_1\bar{I}_A - n_1\frac{1}{2}\bar{I}_B - n_1\frac{1}{2}\bar{I}_C = \frac{1}{\sqrt{2}}[(n_2'+n_2)\bar{I}_1]e^{-j\frac{\pi}{12}}$$

-continued $$(1)\ \bar{I}_A - \frac{1}{2}\bar{I}_B - \frac{1}{2}\bar{I}_C = \frac{1}{\sqrt{2}}\left[\frac{(n_2'+n_2)}{n_1}\bar{I}_1\right]e^{-j\frac{\pi}{12}}$$

$$(2)\ n_1\bar{I}_B - n_1\frac{1}{2}\bar{I}_A - n_1\frac{1}{2}\bar{I}_C = -\frac{1}{2}(n_2'\bar{I}_1 - n_2\bar{I}_2) - \frac{1}{2}(n_2\bar{I}_1 + n_2'\bar{I}_2)$$

$$(2)\ n_1\bar{I}_B - n_1\frac{1}{2}\bar{I}_A - n_1\frac{1}{2}\bar{I}_C = -\frac{1}{2}(n_2'I_1 + j(2+\sqrt{3})n_2'I_1) - \frac{1}{2}\left((2+\sqrt{3})n_2'\bar{I}_1 + jn_2'\bar{I}_1\right)$$

$$(2)\ n_1\bar{I}_B - n_1\frac{1}{2}\bar{I}_A - n_1\frac{1}{2}\bar{I}_C = -\frac{1}{2}\left[\left(1 + j(2+\sqrt{3})\right) + \left((2+\sqrt{3}) + j\right)\right][n_2'\bar{I}_1]$$

$$(2)\ n_1\bar{I}_B - n_1\frac{1}{2}\bar{I}_A - n_1\frac{1}{2}\bar{I}_C = -\frac{1}{2}\left[3+\sqrt{3}+j(3+\sqrt{3})\right][n_2'\bar{I}_1]$$

$$(2)\ n_1\bar{I}_B - n_1\frac{1}{2}\bar{I}_A - n_1\frac{1}{2}\bar{I}_C = -\sqrt{3}\frac{1}{2}\left[1+\sqrt{3}+j(1+\sqrt{3})\right][n_2'\bar{I}_1]$$

$$(2)\ n_1\bar{I}_B - n_1\frac{1}{2}\bar{I}_A - n_1\frac{1}{2}\bar{I}_C = -2\sqrt{2+\sqrt{3}}\ \sqrt{3}\frac{1}{2}\left[\frac{1+\sqrt{3}}{2\sqrt{2+\sqrt{3}}} + j\frac{1+\sqrt{3}}{2\sqrt{2+\sqrt{3}}}\right][n_2'\bar{I}_1]$$

$$(2)\ n_1\bar{I}_B - n_1\frac{1}{2}\bar{I}_A - n_1\frac{1}{2}\bar{I}_C = -\frac{1}{\sqrt{2}}\left[\frac{1+\sqrt{3}}{2\sqrt{2+\sqrt{3}}} + j\frac{1+\sqrt{3}}{2\sqrt{2+\sqrt{3}}}\right][(n_2'+n_2)\bar{I}_1]$$

$$(2)\ n_1\bar{I}_B - n_1\frac{1}{2}\bar{I}_A - n_1\frac{1}{2}\bar{I}_C = -\frac{1}{\sqrt{2}}\left[\sqrt{\left(\frac{1+\sqrt{3}}{2\sqrt{2+\sqrt{3}}}\right)^2} + j\sqrt{\left(\frac{1+\sqrt{3}}{2\sqrt{2+\sqrt{3}}}\right)^2}\right][(n_2'+n_2)\bar{I}_1]$$

$$(2)\ n_1\bar{I}_B - n_1\frac{1}{2}\bar{I}_A - n_1\frac{1}{2}\bar{I}_C = -\frac{1}{\sqrt{2}}\left[\frac{1}{\sqrt{2}} + j\frac{1}{\sqrt{2}}\right][(n_2'+n_2)\bar{I}_1]$$

$$(2)\ n_1\bar{I}_B - n_1\frac{1}{2}\bar{I}_A - n_1\frac{1}{2}\bar{I}_C = \frac{1}{\sqrt{2}}[(n_2'+n_2)I_1]e^{-j\frac{3\pi}{4}}$$

$$(2)\ \bar{I}_B - \frac{1}{2}\bar{I}_A - \frac{1}{2}\bar{I}_C = \frac{1}{\sqrt{2}}\left[\left(\frac{n_2'+n_2}{n_1}\right)\bar{I}_1\right]e^{-j\frac{3\pi}{4}}$$

$$(3)\ n_1\bar{I}_C - n_1\frac{1}{2}\bar{I}_A - n_1\frac{1}{2}\bar{I}_B = n_2'\bar{I}_1 + n_2\bar{I}_2 - \frac{1}{2}(n_2\bar{I}_1 + n_2\bar{I}_2)$$

$$(3)\ n_1\bar{I}_C - n_1\frac{1}{2}\bar{I}_A - n_1\frac{1}{2}\bar{I}_B = n_2'\bar{I}_1 + j(2+\sqrt{3})n_2'\bar{I}_1 - \frac{1}{2}\left((2+\sqrt{3})n_2'\bar{I}_1 + jn_2'\bar{I}_1\right)$$

$$(3)\ n_1\bar{I}_C - n_1\frac{1}{2}\bar{I}_A - n_1\frac{1}{2}\bar{I}_B = \left[1 + j(2+\sqrt{3}) - \frac{1}{2}\left((2+\sqrt{3}) + j\right)\right][n_2'\bar{I}_1]$$

$$(3)\ n_1\bar{I}_C - n_1\frac{1}{2}\bar{I}_A - n_1\frac{1}{2}\bar{I}_B = \left[-\frac{\sqrt{3}}{2} + j\frac{3+2\sqrt{3}}{2}\right][n_2'\bar{I}_1]$$

$$(3)\ n_1\bar{I}_C - n_1\frac{1}{2}\bar{I}_A - n_1\frac{1}{2}\bar{I}_B = \sqrt{3}\left[-\frac{1}{2} + j\frac{\sqrt{3}+2}{2}\right][n_2'\bar{I}_1]$$

$$(3)\ n_1\bar{I}_C - n_1\frac{1}{2}\bar{I}_A - n_1\frac{1}{2}\bar{I}_B = \sqrt{3}\sqrt{2+\sqrt{3}}\left[-\frac{\sqrt{2-\sqrt{3}}}{2} + j\frac{\sqrt{2+\sqrt{3}}}{2}\right][n_2'\bar{I}_1]$$

$$(3)\ n_1\bar{I}_C - n_1\frac{1}{2}\bar{I}_A - n_1\frac{1}{2}\bar{I}_B = \frac{1}{\sqrt{2}}\left[-\frac{\sqrt{2-\sqrt{3}}}{2} + j\frac{\sqrt{2+\sqrt{3}}}{2}\right][(n_2'+n_2)\bar{I}_1]$$

-continued $$(3)\ n_1\bar{I}_C - n_1\frac{1}{2}\bar{I}_A - n_1\frac{1}{2}\bar{I}_B = \frac{1}{\sqrt{2}}[(n'_2+n_2)\bar{I}_1]e^{+j\frac{7\pi}{12}}$$

$$(3)\ \bar{I}_C - n_1\frac{1}{2}\bar{I}_A - \frac{1}{2}\bar{I}_B = \frac{1}{\sqrt{2}}\left[\left(\frac{n'_2+n_2}{n_1}\right)\bar{I}_1\right]e^{+j\frac{7\pi}{12}}$$

To simplify the notations, the following is written:

$$k = \frac{1}{\sqrt{2}}\left(\frac{n'_2+n_2}{n_1}\right)$$

This gives a system of equations in three unknowns $I_A$, $I_B$, and $I_C$:

$$(1)\ \bar{I}_A - \frac{1}{2}\bar{I}_B - \frac{1}{2}\bar{I}_C = k[\bar{I}_1]e^{-j\frac{\pi}{12}}$$

$$(2)\ \bar{I}_B - \frac{1}{2}\bar{I}_A - \frac{1}{2}\bar{I}_C = k[\bar{I}_1]e^{-j\frac{3\pi}{4}}$$

$$(3)\ \bar{I}_C - \frac{1}{2}\bar{I}_A - \frac{1}{2}\bar{I}_B = k[\bar{I}_1]e^{+j\frac{7\pi}{12}}$$

Since (1)+(2)+(3) is equal to zero, the system is constrained and thus possesses an infinity of solutions. However, Kirchhoff's nodal rule (for a delta or a star connection) gives:

$$\bar{I}_A+\bar{I}_B+\bar{I}_C=0$$

so using the above equation, the system becomes:

$$(1)\ \frac{3}{2}\bar{I}_A = k[\bar{I}_1]e^{-j\frac{\pi}{12}}$$

$$(2)\ \frac{3}{2}\bar{I}_B = k[\bar{I}_1]e^{-j\frac{3\pi}{4}}$$

$$(3)\ \frac{3}{2}\bar{I}_C = k[\bar{I}_1]e^{+j\frac{7\pi}{12}}$$

$$\bar{I}_A = \frac{\sqrt{2}}{3}\frac{n'_2+n_2}{n_1}[\bar{I}_1]e^{-j\frac{\pi}{12}}$$

$$\bar{I}_B = \frac{\sqrt{2}}{3}\frac{n'_2+n_2}{n_1}[\bar{I}_1]e^{-j\frac{3\pi}{4}}$$

$$\bar{I}_C = \frac{\sqrt{2}}{3}\frac{n'_2+n_2}{n_1}[\bar{I}_1]e^{+j\frac{7\pi}{12}}$$

$$\bar{I}_A = \frac{\sqrt{2}}{3}\frac{n'_2+n_2}{n_1}[\bar{I}_1]e^{-j\frac{\pi}{12}}$$

$$\bar{I}_B = \frac{\sqrt{2}}{3}\frac{n'_2+n_2}{n_1}[\bar{I}_1]e^{-j\frac{\pi}{12}}e^{-j\frac{2\pi}{3}}$$

$$\bar{I}_C = \frac{\sqrt{2}}{3}\frac{n'_2+n_2}{n_1}[\bar{I}_1]e^{-j\frac{\pi}{12}}e^{+j\frac{2\pi}{3}}$$

Figure 4:
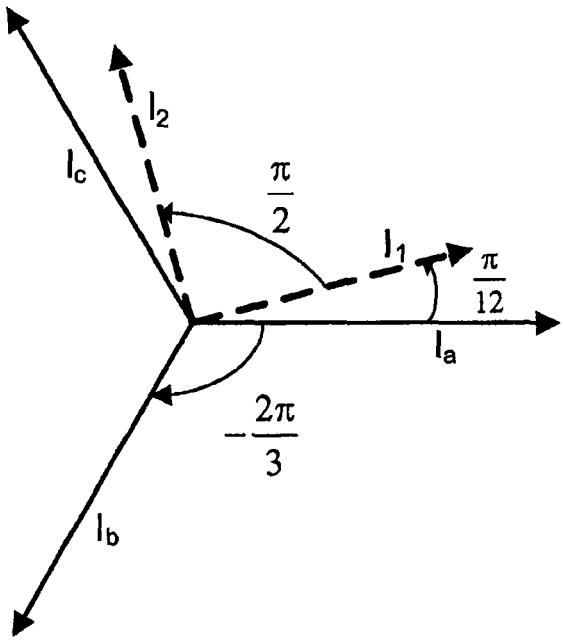
FIG. 4 is a phasor diagram shown the currents in the FIG. 1 transformer.

This is indeed a balanced three-phase system with an offset of $2\pi/3$, as shown in FIG. 4, in which the above-mentioned current ratio can be seen. FIG. 4 is a phasor diagram showing the three-phase currents and the two-phase currents of the transformer 1 of FIG. 1.

In known manner, a transformer may have a plurality of secondaries. Thus, in a variant that is not shown, the transformer 1 includes not only the secondary formed by the windings 9 to 12, but also at least one other two-phase secondary, and/or at least one three-phase secondary, that may be implemented in the same manner as used for the windings 9 to 12. In this variant, the transformer 1 can be used for powering in balanced manner an arbitrary number of loads other than 1. For example, for eleven loads, it is possible to use respective three-phase secondaries on nine loads, and respective two-phase secondaries on two loads: 11=3*3+2.

Figure 5:
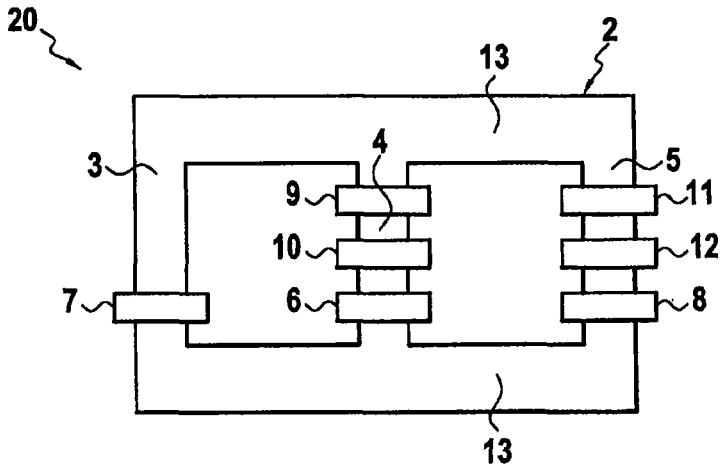
FIG. 5 shows a transformer in a second embodiment of the invention.
Figure 6:
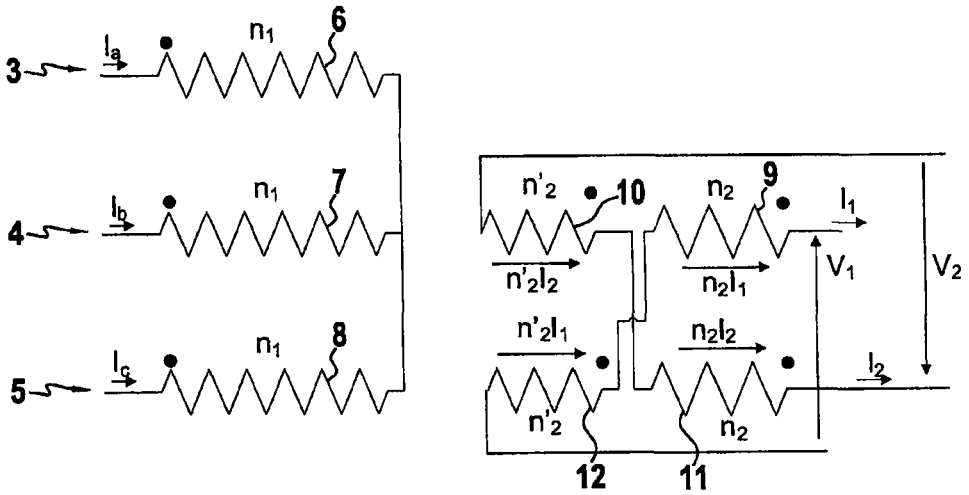
FIG. 6 is an electrical circuit diagram showing the operation of the FIG. 5 transformer.

FIGS. 5 and 6 are similar to FIGS. 1 and 2 respectively, and they show a transformer 20 in a second embodiment of the invention. Elements that are identical or similar to elements of the transformer 1 of FIG. 2 are given the same references and are not described again in detail.

In the transformer 20, the positions of the windings 6, 9, and 10 and the position of the winding 7 are inverted relative to the transformer 1: the windings 6, 9, and 10 surround the central column 4 and the winding 7 surrounds the side column 3. Apart from this difference, the transformer 20 is substantially identical to the transformer 1.

The transformer 20 presents the same above-specified advantages as the transformer 1. In particular, the transformer 20 presents currents and voltages in phase quadrature. The above-mentioned current and voltage ratios are conserved. Nevertheless, the transformer 20 no longer has the same implementation symmetry on its two-phase side, which means there may be a difference in the leakage inductances of the two two-phase phases.

In the transformers 1 and 20 of FIGS. 1 and 5, the columns 3, 4, and 5 are situated parallel to one another in a common plane, which corresponds to a topology commonly used for a magnetic circuit when making a balanced three-phase transformer with forced linked flux and three cores. Nevertheless, in a variant embodiment, a transformer in accordance with the invention may comprise a magnetic circuit having three columns that are magnetically connected together in some other topology.

Figure 7:
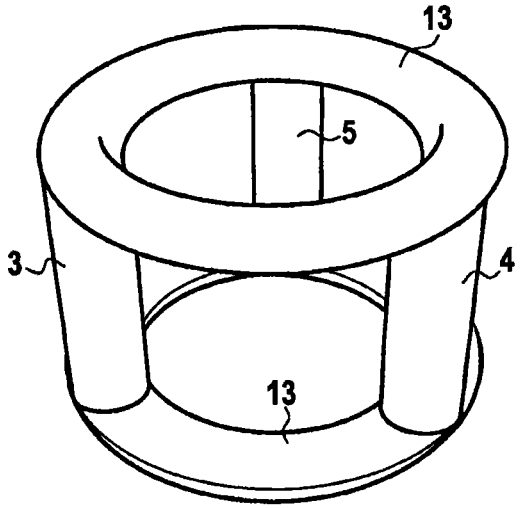
FIGS. 7 and 8 are perspective views of respective three-column magnetic circuits that can be used for making a transformer in accordance with the invention.
Figure 8:
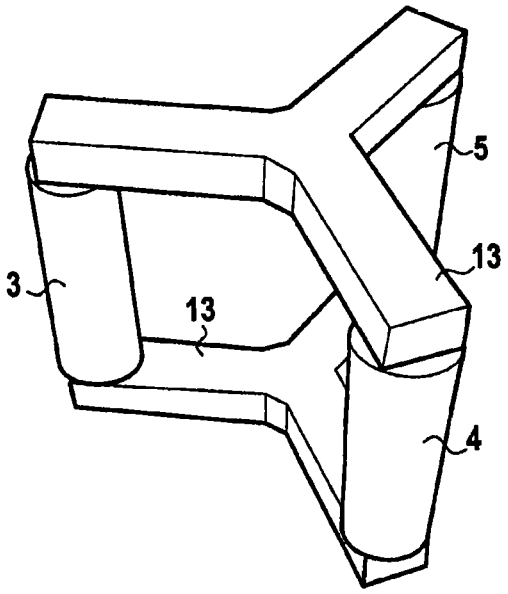

Thus, FIGS. 7 and 8 are respective perspective views of three-column magnetic circuits that can be used for making a transformer in accordance with the invention. In FIGS. 7 and 8, the same references are used as in FIGS. 1 and 5 for designating the corresponding elements, without risk of confusion.

The invention claimed is:

1. A three-phase-two-phase transformer comprising:

a magnetic circuit;

three-phase windings; and two-phase windings, wherein:

the magnetic circuit comprises a first column, a second column, and a third column that are magnetically connected together, the three-phase windings comprise a first winding of $n_1$ turns around the first column, a second winding of $n_1$ turns around the second column, and a third winding of $n_1$ turns around the third column, the two-phase windings comprise a fourth winding of $n_2$ turns around the first column, a fifth winding of $n'_2$ turns around the first column, a sixth winding of $n_2$ turns around the third column, and a seventh winding of $n'_2$ turns around the third column, the fourth winding and the seventh winding are connected in series and form a first two-phase phase, and each of the fourth and seventh windings presents a corresponding winding direction for a current flowing in the first two-phase phase, with magnetic potentials in a same direction, the fifth winding and the sixth winding are connected in series and form a second two-phase phase, and each of the fifth and sixth windings presents a corresponding winding direction for a current flowing in the second two-phase phase, with magnetic potentials in a same direction, and $n_2=(2+\sqrt{3})n'_2$.

2. The transformer according to claim 1, wherein the second column is a central column situated between the first column and the third column.

3. The transformer according to claim 1, wherein the first column is a central column situated between the second column and the third column.

4. The transformer according to claim 2, wherein the magnetic circuit presents symmetry about an axis of rotation contained in the central column and/or about a plane of symmetry containing the central column.

5. The transformer according to claim 3, wherein the magnetic circuit presents symmetry about an axis of rotation contained in the central column and/or about a plane of symmetry containing the central column.

6. The transformer according to claim 1, further comprising at least one additional set of three-phase or two-phase windings.

* * * * *